United States Patent [19]

Kovacs et al.

[11] Patent Number: 4,666,533

[45] Date of Patent: May 19, 1987

[54] HARDENABLE CAST IRON AND THE METHOD OF MAKING CAST IRON

[75] Inventors: Bela V. Kovacs; Roman M. Nowicki, both of Bloomfield Hills, Mich.

[73] Assignee: Ford Motor Company, Dearborn, Mich.

[21] Appl. No.: 772,818

[22] Filed: Sep. 5, 1985

[51] Int. Cl.[4] ..... C21D 1/00

[52] U.S. Cl. ..... 148/2; 148/3; 148/138; 148/321

[58] Field of Search ..... 148/3, 2, 35, 138, 139, 148/141, 12 R, 14, 321, 324; 75/123 CB; 420/9, 13

[56] References Cited

U.S. PATENT DOCUMENTS

| | | | |
|---|---|---|---|
| 2,885,284 | 8/1957 | Moore | 75/124 |
| 4,096,002 | 6/1978 | Ikawa et al. | 148/138 |
| 4,484,953 | 11/1984 | Kovacs | 148/3 |

FOREIGN PATENT DOCUMENTS

| | | | |
|---|---|---|---|
| 54-1223 | 1/1979 | Japan | 75/123 CB |
| 59-59825 | 4/1984 | Japan | 148/138 |
| 60-106944 | 6/1985 | Japan | 148/35 |

OTHER PUBLICATIONS

"Describing the Eutectoid Transformation and Hyper--Eutectic Ductile Cast Irons", Lalich and Loper, AFS Transactions, 1973, pp. 238-244.

"An Investigation of the Effects of Alloying Elements in White Cast Iron, Frich and Lindsay, AFS Transactions, 1974, pp. 65-70.

"Isothermal Transformation of Cementite in Ductile Iron", Datta and Engel, AFS Transactions, 1974, pp. 267-278.

*Primary Examiner*—L. Dewayne Rutledge
*Assistant Examiner*—Deborah Yee
*Attorney, Agent, or Firm*—Joseph W. Malleck; Roger L. May

[57] ABSTRACT

A method is disclosed for forming a surface hardenable cast iron article by development of metastable retained austenite in the cell boundary of a ductile or semiductile cast iron. The method comprises (a) controlling the solidification of a cast iron melt to extend the eutectic arrest time to 4-12 minutes, the melt having by weight percent a carbon equivalent (carbon plus one-third silicon) equal to 4.3-5.0, manganese 0.55-1.2, nickel 0.5-3.0, and the remainder essentially iron, the melt having been treated to form cell boundaries in the solidified iron with a high proportion of the manganese being segregated in the cell boundaries; (b) subjecting the solidified cast iron to an austempering heat treatment to permit the segregated manganese in the cell boundaries to form metastable retained austenite; and (c) terminating the heat treatment prior to the conversion of the metastable austenite to a stable microstructure. To obtain the benefits of wear resistance, the method further comprises using the heat treated cast iron by stressing a surface region thereof and transforming the microstructure of such surface region to martensite.

15 Claims, 10 Drawing Figures

HARDENABLE CAST IRON AND THE METHOD OF MAKING CAST IRON

TECHNICAL FIELD

This invention relates to the art of making graphitized irons and to the art of treating such irons to obtain increased physical characteristics with particular emphasis on surface wear resistance.

BACKGROUND OF INVENTION AND PRIOR ART STATEMENT

Wear resistant cast irons have heretofore been primarily of the carbidic type. Unfortunately the carbides are normally massive and impart brittleness to the cast iron which limits its usefulness. The presence of manganese in gray or white cast irons exaggerates the formation of carbides because manganese acts as a carbide former. When manganese is present in excess of 1% by weight, the iron is difficult to machine. Such carbidic cast irons can be heat treated, but the desirable combination of physical characteristics represented in graphitized irons such as high toughness (50–60 ft/lb), high yield strengths (about 100 ksi), machinability and high tensile strengths (about 130–140 ksi) can never be achieved, regardless of the heat treatment. Because manganese is recognized as an effective carbide former, it is limited to amounts of 0.5–1.0% by weight in conventional graphitic cast irons (see "Describing the Eutectoid Transformation and Hyper-Eutectic Ductile Cast Irons", M. J. Lalich and C. R. Loper, AFS Transactions, 1973, pp. 238–244). As a result, such graphitic irons will have essentially a pearlitic matrix with less than desirable wear resistance and are difficult to machine.

Graphitizing agents, such as silicon and/or aluminum, are essential to the making of nodular ductile iron or compacted graphite iron, and will tend to counteract carbide formations even with high manganese contents; but the silicon or aluminum is balanced against the manganese in such irons because the iron still relies on the presence of carbide structures throughout the matrix of the metal to obtain some degree of wear resistance (see U.S. Pat. No. 2,885,284).

The use of manganese in ductile cast irons along with hardenability agents or pearlite-delaying alloying ingredients such as nickel, molybdenum and copper have been investigated and there is no evidence of the discovery of any method by which surface hardenable characteristics may be obtained while retaining all of the conventional desirable characteristics of ductile iron in the core of the cast iron part (see "An Investigation of the Effects of Alloying Elements in White Cast Iron", by Frick and Lindsay, AFS Transactions, 1974, pp. 65–70; and "Isothermal Transformations of Cementite in Ductile Iron", by Datta and Engel, AFS Transactions, 1974, pp. 267–278). To obtain the combination of good toughness and strength in the core and good wear resistance at the surface, the processing technique must be revised in a novel manner.

SUMMARY OF INVENTION

The invention is a method of forming a surface hardenable cast iron article by development of metastable retained austenite in the cell boundary of a ductile or semiductile (compacted graphite) cast iron.

The method comprises (a) controlling the solidification of a cast iron melt to extend the eutectic arrest time to 4–12 minutes to form a solidified article having all boundaries with a high concentration of segregated manganese, the melt having by weight percent a carbon equivalent (carbon plus one-third silicon) equal to 4.3–5.0, manganese 0.55–1.2, nickel 0.5–3.0, and the remainder essentially ductile or semiductile iron chemistry; (b) subjecting the solidified cast iron to an austempering heat treatment to permit the segregated manganese in the cell boundaries to form metastable retained austenite; and (c) terminating the heat treatment prior to the conversion of the metastable austenite to a stable microstructure.

Preferably, the melt contains carbon in the range of 3.5–3.8%, manganese in the range of 0.8–1.2%, silicon in the range of 2.4–2.8%, sulphur no greater than 0.015%, and phosphorus no greater than 0.06%. Advantageously, molybdenum may be used in the range of 0–0.5%, or copper in the range of 0–3.0%, as a substitute for nickel, nickel still being present in an amount of 0.5–2.8% (depending on amount of Mo or Cu used) to increase hardenability and prevent pearlite formation.

To obtain the benefits of wear resistance, the method may further comprise using the heat treated cast iron in a manner to stress a surface region thereof and transform the microstructure of such surface region to martensite. The stress level may be advantageously at least 80,000 psi and carried out by rolling or burnishing; the stressed surface is elevated to a hardness of about 50–60 Rc while the core of such iron remains at 28–32 Rc.

SUMMARY OF THE DRAWINGS

FIG. 3 is a schematic illustration of the microstructure of a cast iron resulting from the heat treatment in FIG. 2;

FIG. 4, particularly, is a photograph (500× magnification) of the microstructure of a cast iron processed according to this invention but prepared with insufficient manganese; FIG. 5 is a photograph (300× magnification) of the microstructure of a cast iron having chemistry corresponding to this invention but processed improperly with insufficient control of the eutectic arrest time period during solidification; FIG. 6 is a photograph (250× magnification) of a cast iron processed correctly according to this invention but containing excess manganese; FIG. 7 is a photograph (100× magnification) of a cast iron processed correctly according this invention;

FIG. 8, particularly, is a photograph (500× magnification) of a cast iron having a microstructure resulting from processing that contained too short an arrest time but with low end chemistry resulting in fewer martensite plates than desirable; FIG. 9 is a photograph (500× magnification) of a cast iron processed according to this invention and having the chemistry within the ranges required by this invention; FIG. 10 is a photograph (100× magnification) evidencing the difference in hardness of the martensitic microstructure converted from the metastable austenite and visual evidence of the hardness of the austenite and ferrite matrix of such cast iron.

DETAILED DESCRIPTION AND BEST MODE

Figure 1:
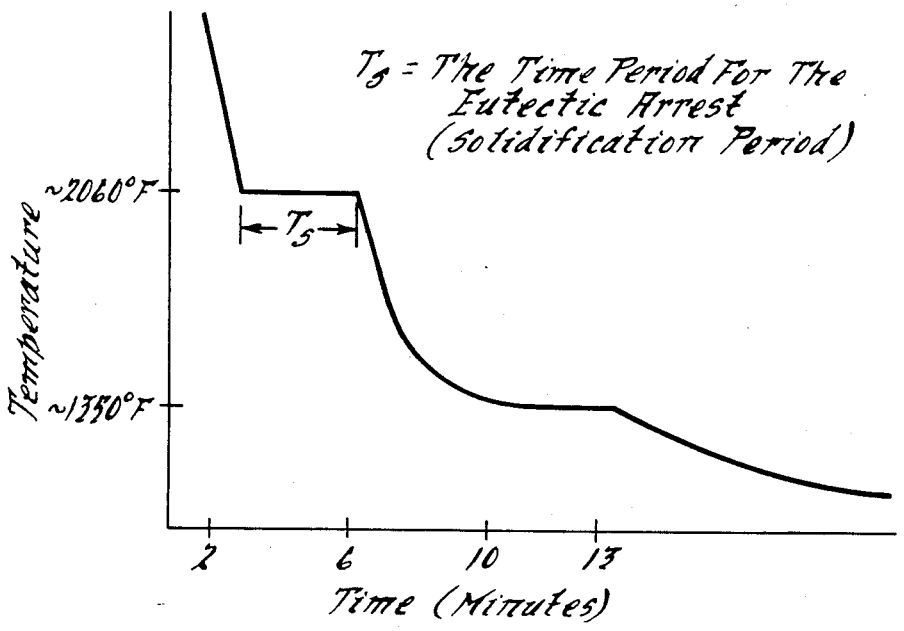
FIG. 1 is a graphical plot of temperature versus time in the solidification of an iron melt responding to the needs of this invention.

To form an in-service surface hardenable ductile or semiductile cast iron: (a) the melt for such is characterized by special chemistry and the melt is controlled during solidification to segregate some of the special chemistry in the cell boundaries; (b) the solidified iron is given an austempering heat treatment; and (c) the heat treatment is terminated before completion. Such hardenable cast iron is hardenable by subjecting at least one surface region to stress to precipitate a hard, stable microstructure at such region.

CHEMISTRY

The iron melt is constituted of ductile or semiductile iron having, by weight percent, a carbon equivalent (carbon plus one-third silicon) equal to 4.3–5.0, manganese 0.55–1.2 (preferably 0.8–1.2), nickel 0.5–3.0, and the remainder essentially iron. Ductile or semiductile iron should have, by weight percent, carbon in the range of 3.5–3.8, silicon 2.4–2.8, sulphur no greater than 0.015, and phosphorus no greater than 0.06. Nickel may be supplemented by molybdenum in the range of 0.1–0.5% and by copper in the range of 0.5–3.0%; when so supplemented, nickel should be used in the range of 0.1–2.0% to insure an increase in hardenability of the cast iron and to prevent pearlite formation. If ductile iron, magnesium will be present in the range of 0.03–0.06 weight percent, and if semiductile (compacted graphite), magnesium will be present in the range of 0.015–0.029 weight percent.

Manganese is used here not as pearlite stabilizer or carbide former but as a precursor for retained austenite. Most of the manganese will segregate out from the core or matrix grains into the cell boundary by the solidification treatment applied. If manganese is below 0.55 weight percent, it will not segregate adequately into the cell boundary during solidification of the melt. More satisfactory segregation is obtained if the manganese is not below 0.8 weight percent. If manganese exceeds 1.2 weight percent, unwanted eutectic carbides will begin to form, affecting the physical properties of the matrix of the cast iron.

Nickel is present to function as an agent to increase hardenability of the matrix, i.e., to prevent pearlite formation during quenching, and does not segregate out into the cell boundary. If nickel is the only hardenability agent present and is below 0.5 weight percent, pearlite will form. If nickel exceeds 3.0 weight percent, no beneficial effects are achieved and higher processing costs occur. If the carbon equivalent were to exceed 5.0 weight percent, there would be excessive graphite formation and the graphite would tend to float to the surface of the cast iron during solidification.

MELT SOLIDIFICATION

The control of heat removal during solidification of the melt is provided as shown in FIG. 1. The length of the eutectic arrest ($T_s$) is prolonged to fall within the time span of 4–12 minutes. The eutectic arrest will occur at approximately a temperature level of 2060° F. All of the melt essentially freezes out at the same temperature. The length of the eutectic arrest is controlled by regulating the rate of heat extraction. It is during this eutectic arrest period that the manganese content of the melt segregates into the cell boundaries of an iron melt treated for producing ductile or semiductile iron. If the eutectic arrest period is less than four minutes, the manganese will not have sufficient time to segregate and will not enrich the melt for promoting segregation as solidification occurs in the cell boundaries. If the eutectic arrest period is prolonged over 12 minutes, there is a fading or nodule degeneration of the ductile iron or semiductile iron and the formation of eutectic carbides may occur.

By controlling the eutectic arrest period to that time prescribed, at least 75% of the manganese will segregate out in the cell boundaries, and the concentration of the manganese across a cell boundary will exhibit a peak concentration of manganese at the mid-region of about 10 times the concentration at the edge of the cell boundary (next to a nodule). The manganese content will range from 3 to 10% by weight of the material in the cell boundary. The matrix of the solidified iron is ferrite and pearlite, with a pearlitic cell boundary containing high manganese segregate. If the cast iron is to be shaped by machining, such is done prior to the heat treatment that follows.

This treatment operates only with ductile or semiductile irons since a cell boundary zone is little or nonexistant with gray irons.

AUSTEMPER HEAT TREATMENT

Figure 2:
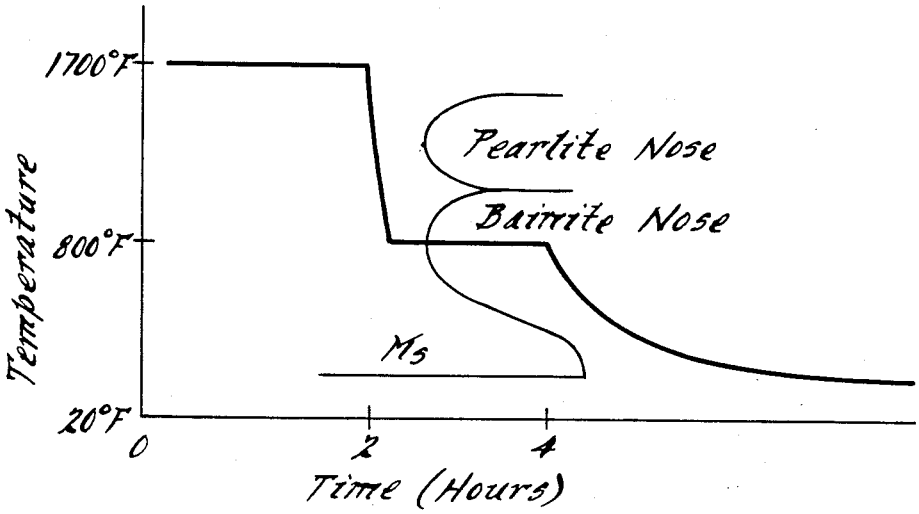
FIG. 2 is a graphical illustration of temperature versus time in the heat treatment of a controlled, cooled iron.
Figure 2:
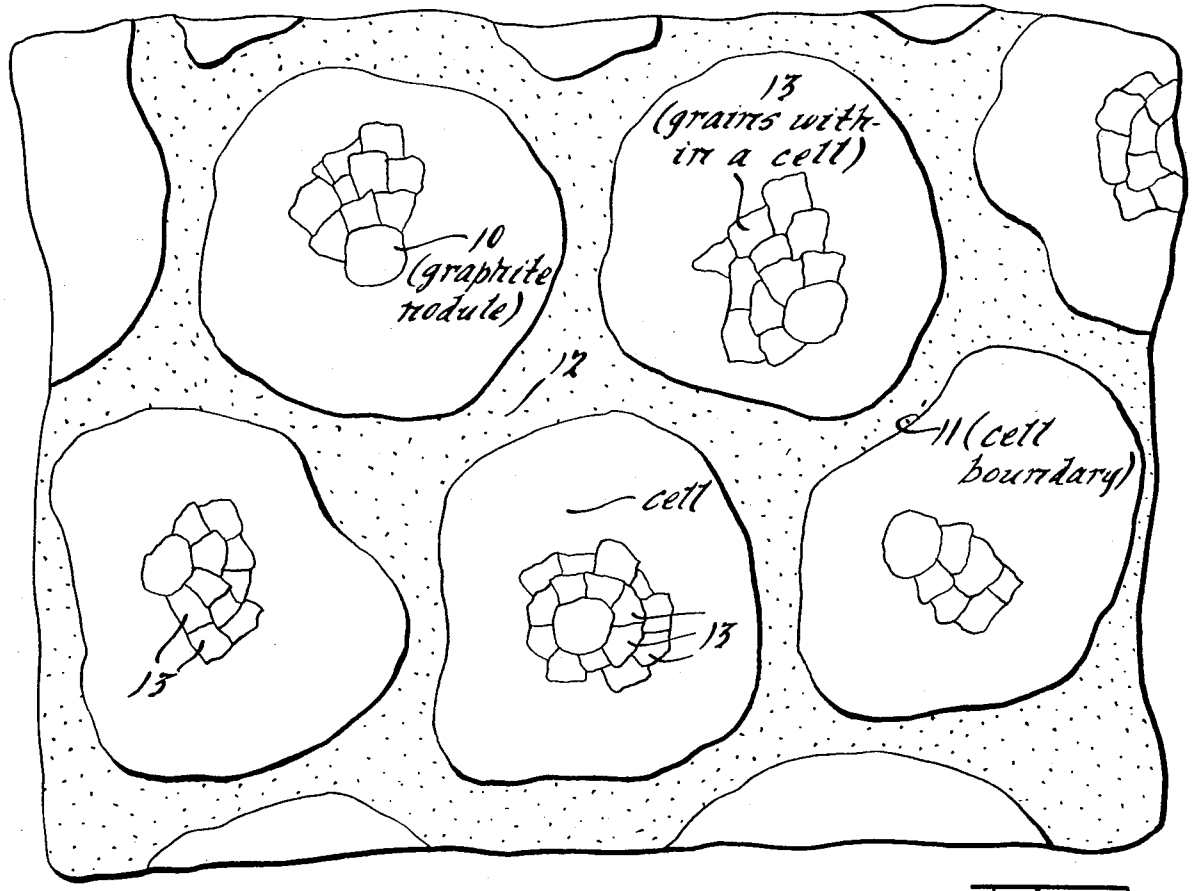

Turning to FIG. 2, the solidified cast iron is subjected to an austempering heat treatment which specifically comprises heating the iron to a high austenitizing temperature condition, preferably to about 1700° F. (plus or minus 25° F.) and holding at this austenitizing temperature to obtain high carbon austenite in the matrix. This will usually require about two hours. The minimum time at such austenitizing temperature is suggested to be about one hour, and the maximum time is suggested to be about four hours, based upon economics. The austenitized iron will have a mixed matrix phase consisting of high carbon austenite and graphite and cell boundaries of austenite with high manganese.

The austenitized iron is then quenched at a rate of at least 250° F./min to the temperature of 800° F. (plus or minus 25° F.); however, when the temperature of 1100° F. is reached, the rate of cooling does not have to be as fast as 250° F./min. but can be slow enough as long as the pearlite nose is avoided. The 800° F. temperature level is held for two hours (1.5–2.5 hours). The cast iron will contain acicular high carbon austenite and ferrite in the matrix and cellular metastable retained austenite (induced by the manganese segregate), which austenite is thermally stable but mechanically unstable and upon stressing will transform to martensite. The heat treated cast iron will have a hardness of 28–32 Rc. Bainite is not present in the matrix or cell boundary in any significant amount.

TERMINATE HEAT TREATMENT

The heat treatment is terminated prior to the conversion of the metastable austenite to a stable structure such as bainite; this requires about two hours (1.5–2.5 hours). The iron is allowed to air cool to room temperature. If such temperature was held for a period of, for example, 4–6 hours, substantial conversion of the austempered structure to undesirable bainite could occur.

SURFACE HARDENING BY MECHANICAL STRESS

The heat treated and shaped cast iron can be given a final grinding and then placed into service. In use, such as in a camshaft, certain surface zones of the camshaft will be placed in mechanical stress sufficient to cause transformation of metastable retained austenite to martensite. Such stresses can range from a small force up to 200,000 psi (depending on local carbon content) to create a point transformation on the surface; however, if an overall surface zone or region is to be transformed, it is advantageous if a threshold level of 80,000 psi be employed to cause conversion of the metastable retained austenite to martensite, martensite having a hardness in a range of 50–60 Rc.

COMPOSITION

As shown in FIG. 3, the inventive composition herein is a ductile or semiductile heat treated cast iron having a matrix consisting of a substantially uniform distribution of acicular austenite and ferrite grains 13 lith graphite nodules 10 distributed throughout the matrix and containing, in the zone 12 in the cell boundaries 11, a high carbon metastable retained austenite. The cast iron has an impact strength of 50–60 ft/lb, a yield strength of at least 100 ksi, a tensile strength of 130–140 ksi, and a core hardness of 28–32 Rc. The high carbon metastable retained austenite is convertable to martensite at a surface zone of the cast iron upon the application of mechanical stress thereto.

The preferred composition consists essentially of by weight percent a carbon equivalent (carbon plus one-third silicon) which is in the range of 4.3–5.0, a manganese content of 0.8–1.2, a maximum sulphur of 0.015, a phosphorus content of 0.06, nickel in the range of 0.5–3.0, molybdenum in the range of 0–0.5, copper as a substitute for nickel in the range of 0–3.0, and a residual content of magnesium in the range of 0.03–0.06 when a fully ductile iron is prepared and in the range of 0.015–0.029 when a semiductile cast iron (compacted graphite) is prepared.

In order to illustrate more clearly the criticality of the chemistry and processing of this invention, several samples were prepared and processed with certain variables in the chemistry and certain variables in the processing to corroborate the invention herein (see Table I). Each of the samples had a carbon equivalent of about 4.5 weight percent, and the sulphur and phosphorus contents were in the ranges required. The iron was treated with magnesium to obtain a ductile iron. Only the manganese, nickel, molybdenum or copper alloying elements were varied to obtain information as to their effect upon the product. Each of samples 1 and 3 were unable to develop the proper ductile iron with an adequate presence of cellular metastable retained austenite. When the processing was varied by control of the excessive arrest time, such as shown by Example 2, the resulting iron lacked adequate ductile iron physical characteristics. In sample 4 a very desirable cast iron product was obtained.

Figure 4:
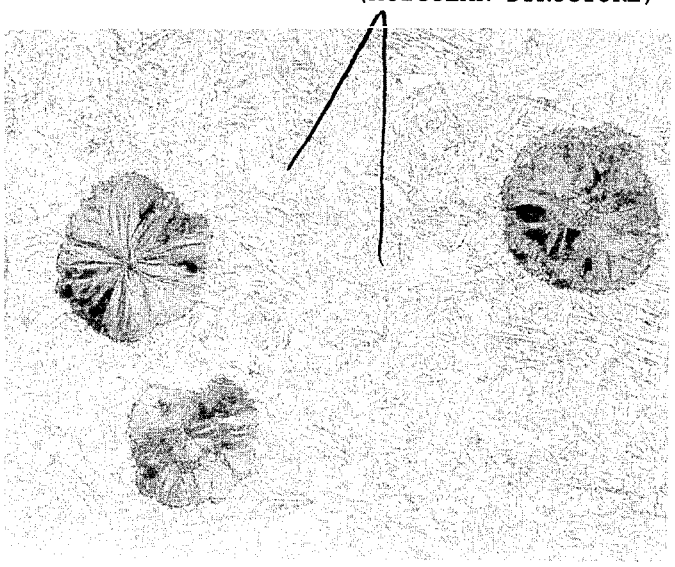
FIGS. 4–7 are each photographs of the microstructure of a cast iron in the heat treated condition prior to use as an applied part.
Figure 5:
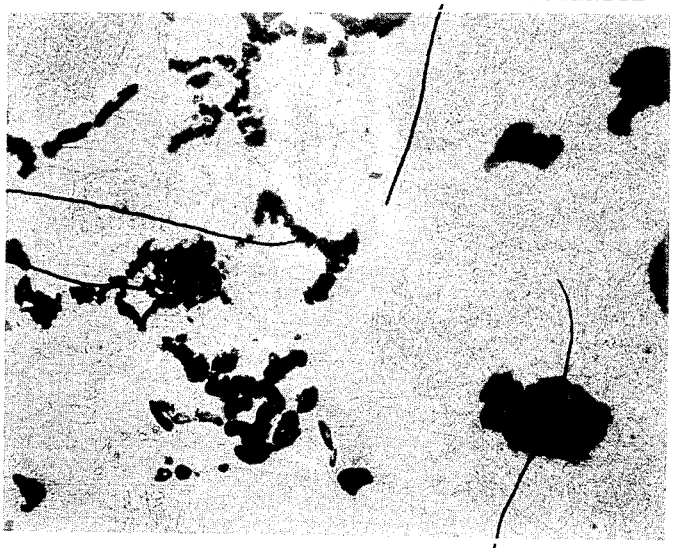

If the manganese content of the cast iron is too low (such as in sample 1), very little manganese segregation will take place in the cell boundaries of the solidified melt, such segregation being critical to the stimulation and generation of metastable austenite in such cell boundaries. As a result, no segregation will be apparent (such as shown in FIG. 4). The cast iron of FIG. 4 was prepared with manganese of only 0.2% and the eutectic arrest was held to under four minutes. As a result, the treated iron of FIG. 4 had no retained austenite but did contain high carbon austenite and ferrite in the matrix between the graphite nodules. The same effect can be generated by processing the cast iron at too low a temperature both for austenitizing, such as below 1675° F., and for a quenched temperature, such as at the level of 675° F. The absence of the desired manganese segregation is an insurmountable obstacle to obtaining the effects of this invention. If the eutectic arrest is prolonged beyond 12 minutes, austenite will be retained, provided the chemistry is correct, but fading of the nodularizing agent will occur resulting in either quasi-flake definition (compacted graphite) or flake definition. FIG. 5 illustrates such an iron with compacted graphite.

Figure 6:
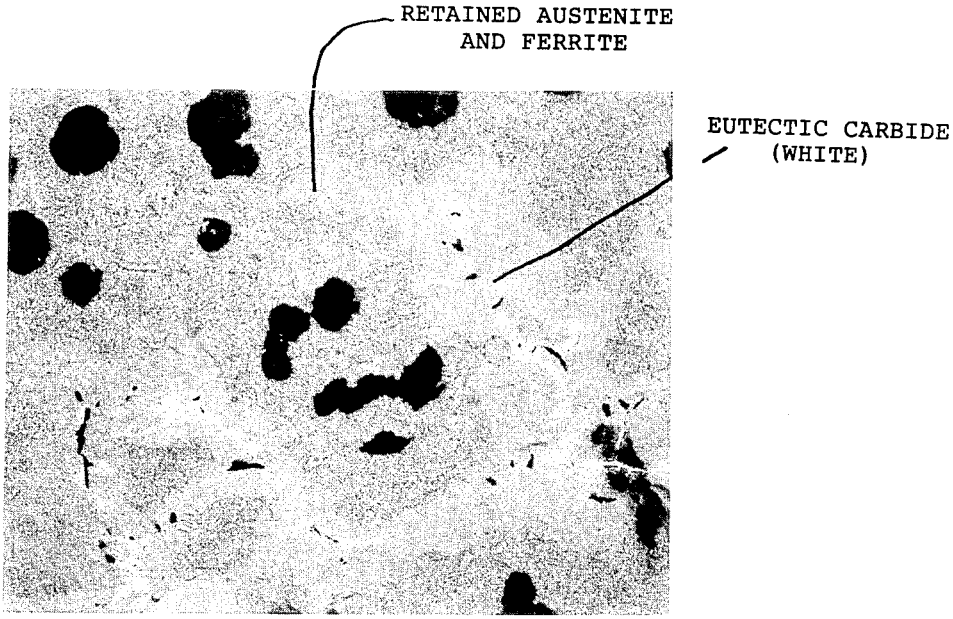

If the manganese content is too high, such as at a level of 1.5%, eutectic carbides will form during solidification, which reduces ductility and machinability. This is clearly shown in FIG. 6 with the white areas representing eutectic carbide; in addition, there was some nodule degeneration due to excessive eutectic arrest time. The darker gray areas are retained austenite and ferrite.

Figure 7:
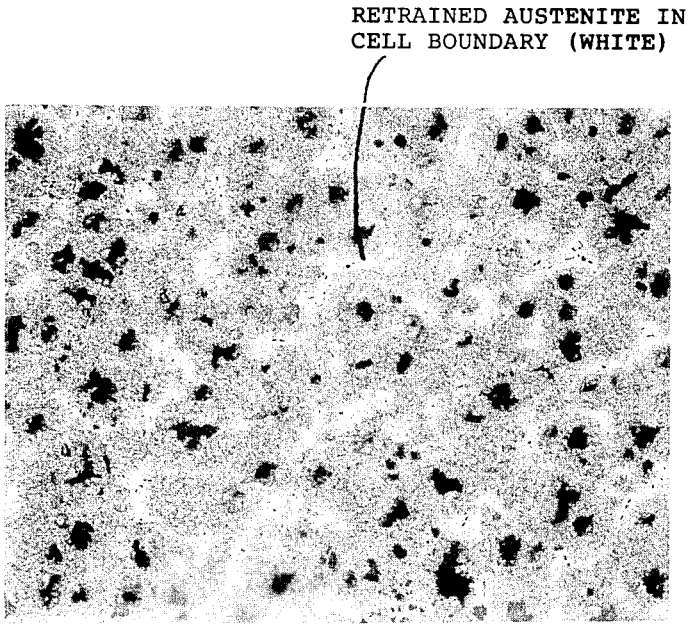

If the manganese content is correct, along with the other processing criteria of this invention, the novel microstructure of this invention will appear as that of sample 4 and is shown in FIG. 7. The white areas are metastable retained austenite in the cell boundaries, all of which is available for eventual martensitic transformation by in-service surface stress.

Figure 8:
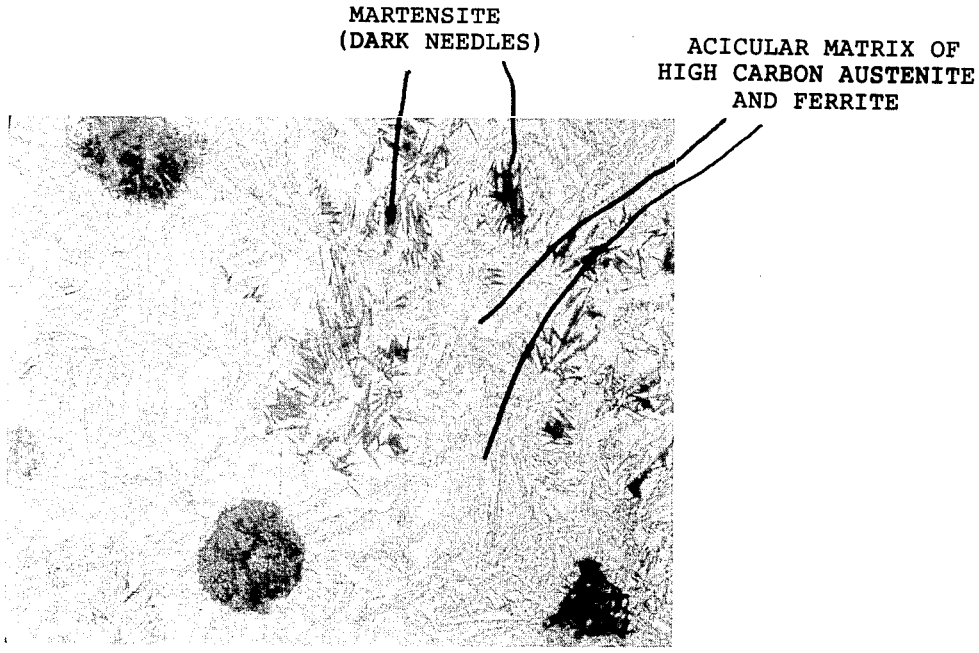
FIGS. 8–10 are photographs of the microstructure of cast irons which not only have been heat treated but have been mechanically stressed by use of the cast iron in a product under surface stress conditions.

Another compositional form of this invention is that of a ductile or semiductile heat treated cast iron which has been subjected to surface mechanical stress, the composition is then characterized by a cast iron matrix consisting of acicular austenite and ferrite with graphite nodules distributed throughout the matrix, and containing martensite in the cell boundaries, the cast iron having an impact strength of 50–60 ft/lb, a yield strength of at leat 100 ksi, a tensile strength of 130–140 ksi, and a mechanically stressed surface hardness of 50–60 Rc. The microstructure of such a mechanically stressed, heat treated cast iron is sample 6 and is shown in FIG. 8. Notice the patchy distribution of martensite (dark needles) in the rest of the matrix of the material; the cell boundary has an acicular structure of high carbon austenite, ferrite, and martensite. However, since the manganese was at the low end of the acceptable range (0.55%) and the processing contained too short an arrest time (less than four minutes), the amount of martensite was limited; limited martensite was created by using a high solidification rate so that the arrest time was somewhat less than four minutes.

Figure 9:
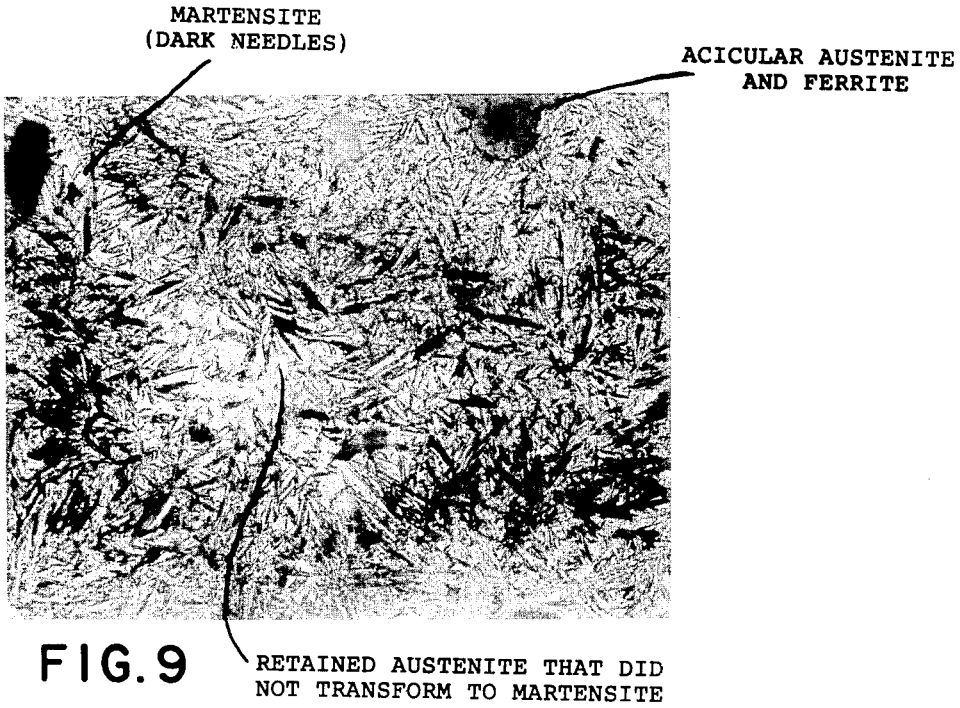
Figure 10:
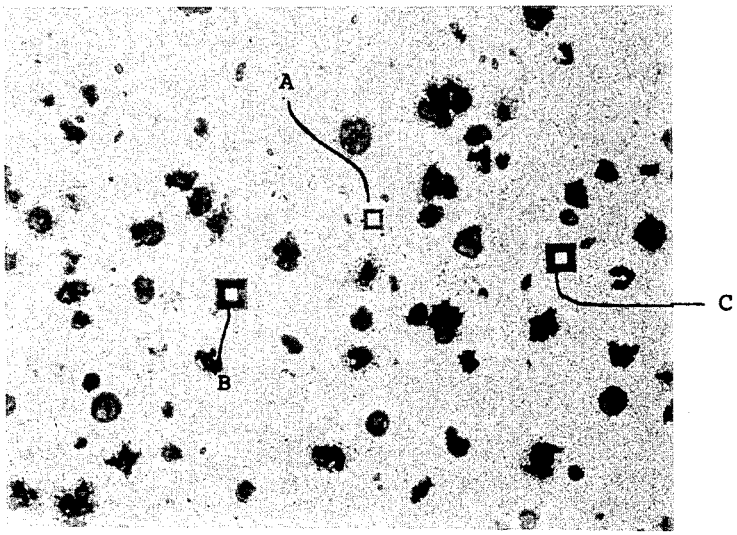

FIG. 9 shows the microstructure for sample 4, an excellent cast iron that has considerable martensite converted from a significant amount of retained austenite in the cell boundaries. FIG. 10 visually illustrates for sample 4 the difference in hardness between the austenite and ferrite in the matrix and martensite in the cell boundary; the indenter shows a much greater indented area due to deeper penetration and thus a softer material in the austenite and ferrite at B and C; the indenter shows a much smaller indented zone in the martensite at A having been resisted by the greater hardness of such martensite.

The other samples in Table I indicate that molybdenum can be used along with nickel in an amount of 0.3% as in sample 7 (acceptable range of 0–0.5%). Molybdenum should not exceed 0.5% because it affects nonuniform heat treatment through segregation. Copper can alternatively be used in an amount of up to 3.0% as a direct substitute for nickel (see sample 8 using 1.5% Cu). When nodularization is absent from the processing, the physical properties resulting from following the other steps of this invention are not satisfactory.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

TABLE I

| Sample | Mn (Weight Percent) | Ni | Mo | Cu | Arrest Time (min.) | Austemper (1770° F./ 800° F.) | Presence of Cellular Metastable Retained Austenite | Good Ductile Iron |
|---|---|---|---|---|---|---|---|---|
| 1 | .3 | 1.5 | 0 | 0 | 8 | Yes | No | Yes |
| 2 | .95 | 1.5 | 0 | 0 | 20 | Yes | Yes | No |
| 3 | 1.5 | 1.5 | 0 | 0 | 8 | Yes | Some | Degenerating Ductile Iron |
| 4 | 1.0 | 1.5 | 0 | 0 | 8 | Yes | Yes | Yes |
| 5 | 1.0 | 1.5 | 0 | 0 | 2 | Yes | No | Yes |
| 6 | .55 | 1.5 | 0 | 0 | 8 | Yes | Some | Yes |
| 7 | 1.0 | 1.0 | .3 | 0 | 8 | Yes | Yes | Yes |
| 8 | 1.0 | .5 | 0 | 1.5 | 8 | Yes | Yes | Yes (but degrading if compact prop.) |
| 9 | 1.2 | 2.0 | 0 | 0 | 8 | Yes | Yes | Compacted Graphite Iron |
| 10 | 1.0 | 1.5 | 0 | 0 | 8 | Yes | No (no cell boundaries) | No (gray iron) |

We claim:

1. A method of forming a surface hardenable article of ductile or semiductile (compacted graphite) cast iron, comprising:

(a) controlling the solidification of a melt of said cast iron to extend the eutectic arrest time to 4–12 minutes and to form a solidified article having cell boundaries with a high concentration of segregated manganese, the melt having by weight percent a carbon equivalent (carbon plus one-third silicon) equal to 4.3–5.0, manganese 0.55–1.2, nickel 0.5–3.0, and the remainder essentially ductile or semiductile iron chemistry;

(b) subjecting the solidified cast iron to an austempering heat treatment to permit the segregated manganese in the cell boundaries to form metastable retained austenite; and (c) terminating the heat treatment prior to the conversion of the metastable austenite to a stable microstructure.

2. The method as in claim 1, in which said melt is comprised of carbon in the weight percent range of 3.5–3.8, silicon in the weight percent range of 2.4–2.8, sulphur no greater than 0.015 weight percent, and phosphorus no greater than 0.06 weight percent.

3. The method as in claim 2, in which said melt is further characterized by the presence of molybdenum in the weight percent range of 0–0.5, or copper in the weight percent range of 0–3.0 as a partial substitute for nickel, nickel still being present in an effective amount to increase hardenability of the solidified cast iron and to substantially prevent pearlite formation.

4. The method as in claim 1, in which said melt solidifies as ductile iron with a content of magnesium in the weight percent range of 0.03–0.06.

5. The method as in claim 1, in which said melt solidifies as compacted graphite iron with magnesium present in the weight percent range of 0.02–0.03.

6. The method as in claim 1, in which said austempering heat treatment comprises heating said solidified iron to a temperature in the range of 1675°–1725° F. for a period to achieve substantial austenization of said iron and then quenching to the temperature range of 775°–825° F. for a period no greater than two hours to prevent the formation of bainite followed by air cooling.

7. The method as in claim 6, in which said austenization temperature is maintained for a period of at least two hours.

8. The method as in claim 1, in which said manganese is present in said melt in the weight percent range of 0.8–1.2.

9. The method as in claim 1, in which said melt is solidified in a manner so that at least 75% of said manganese is segregated within the cell boundaries thereof.

10. A method of making a more wear resistant cast iron shape, comprising:

(a) controlling the solidification of a cast iron melt to extend the eutectic arrest time to 4–12 minutes and to form a solidified cast iron shape, said melt having by weight percent a carbon equivalent (carbon plus one-third silicon) equal to 4.3–5.0, at least 0.8 manganese, nickel 0.5–3.0, and the remainder essentially iron, said melt having been treated to form cell boundaries in the solidified iron with a high proportion of said manganese being segregated in said cell boundaries;

(b) subjecting said solidified cast iron shape to an austempering heat treatment to permit said segregated manganese in cell boundaries to form metastable retained austenite;

(c) terminating said heat treatment prior to the conversion of said metastable austenite retained to a stable microstructure; and (d) using said heat treated cast iron shape in a manner to transform a selected surface region of said metastable retained austenite to martensite by stressing said surface region, said martensite having a high resistance to wear.

11. The method as in claim 10, in which said use is carried out by rolling or burnishing.

12. The method as in claim 10, in which said use is carried out in a manner to provide a level of stress in an amount of at least 80,000 psi.

13. The method as in claim 10, in which the selected surface region of said cast iron shape is characterized by a hardness of about 50–60 Rc.

14. A ductile or semiductile cast iron composition characterized by a matrix consisting of acicular high carbon austenite and ferrite and a cell boundary containing meta-stable retained austenite and manganese in an amount ranging from 3–10 weight percent of the material in the cell boundary, said retained austenite being convertible to martensite upon the application of mechanical stress.

15. The composition as in claim 14, in which the core of said composition is characterized by a toughness of 50–60 ft/lb (impact strength), a yield strength of at least about 100 ksi, a tensile strength of 130–140 ksi, and a hardness of 28–32 Rc.

* * * * *